US006598361B2

(12) United States Patent
Ting

(10) Patent No.: US 6,598,361 B2
(45) Date of Patent: Jul. 29, 2003

(54) MULLION SPLICE JOINT DESIGN

(76) Inventor: Raymond M. L. Ting, 318 Holiday Dr., Pittsburgh, PA (US) 15237

( * ) Notice: Subject to any disclaimer, the term of this patent is extended or adjusted under 35 U.S.C. 154(b) by 0 days.

(21) Appl. No.: 09/933,689

(22) Filed: Aug. 20, 2001

(65) Prior Publication Data

US 2003/0033764 A1 Feb. 20, 2003

(51) Int. Cl.[7] ..... E04H 1/00; E04H 14/00; E04B 1/343

(52) U.S. Cl. ..... 52/235; 52/573.1

(58) Field of Search ..... 52/235, 573.1, 52/726.1

(56) References Cited

U.S. PATENT DOCUMENTS

| | | | | |
|---|---|---|---|---|
| 3,357,145 | A | * | 12/1967 | Grossman |
| 3,697,723 | A | * | 10/1972 | Winsler |
| 3,802,127 | A | | 4/1974 | Silvernail |
| 3,859,754 | A | | 1/1975 | Budich |
| 3,998,016 | A | | 12/1976 | Ting |
| 4,078,350 | A | | 3/1978 | Ting |
| 4,086,727 | A | | 5/1978 | Kuyper |
| 4,133,158 | A | | 1/1979 | Ting |

(List continued on next page.)

FOREIGN PATENT DOCUMENTS

| | | | |
|---|---|---|---|
| DE | 3341-494 A | * | 11/1983 |
| GB | 928673 | * | 6/1963 |

OTHER PUBLICATIONS

"Rain Screen Cladding, Air Barriers, and Curtain Walls" by Richard Keleher, pp. 37–40, The Construction Specifier Feb. 2000.

"1600 Wall Screw Spoling Specifications, Pictorial View Details" from Product Specification published by Kawneer Co., Inc. 1987–1989.

"Wausau Guid Specifications: 5" Thermal Barrier Structural Glazed Window System" Model 62506 Guide Specifications & related drawings from Product Specifications published by Wausau Metals Corporation.

"Curtainwall Window Wall Systems" YCW 750 Product Specifications & Pictorial View, pp. El–18 to El–24 & El–1 to El–3, published by YKK America, Inc. 1994.

"Ounce of Prevention", Pittsburgh Business Times, Dec. 17, 1999.

"Tingwall a Revolution in Curtainwall Technology" Brochure published by Advanced Building Systems, Inc. 2000.

*Primary Examiner*—Carl D. Friedman
*Assistant Examiner*—Kevin McDermott
(74) *Attorney, Agent, or Firm*—Webb Ziesenheim Logsdon Orkin & Hanson, P.C.

(57) ABSTRACT

Slidable connections from a support to a supported section combined with slidable end connections between adjoining supported sections allow relative motion between adjoining supported sections to be limited to less than the relative motion between adjoining supports. This is accomplished in an open-gap mullion embodiment for supporting a curtain wall assembly by providing an open gap between mullion sections equal to or less than a tolerable range for the curtain wall. When floor support deflections close the gap, further floor deflection causes an adjacent lower mullion section to provide support for the contacted upper mullion section. In a limited-gap embodiment, the gap between mullion section may exceed the tolerable motion of the associated curtain wall assembly, but a slidable gap-limiting means is provided to limit relative displacement between sections. In addition, the slidable mullion sections can be field installed without the need for field drilling and/or welding.

18 Claims, 12 Drawing Sheets

U.S. PATENT DOCUMENTS

| | | | | |
|---|---|---|---|---|
| 4,176,503 | A | | 12/1979 | Ting |
| 4,184,301 | A | | 1/1980 | Anderson |
| 4,229,905 | A | | 10/1980 | Rush |
| 4,316,351 | A | | 2/1982 | Ting |
| 4,346,538 | A | | 8/1982 | Ting |
| 4,413,458 | A | | 11/1983 | Ting |
| 4,525,966 | A | | 7/1985 | Litchfield et al. |
| 4,598,513 | A | | 7/1986 | Gartner |
| 4,685,263 | A | | 8/1987 | Ting |
| 4,700,520 | A | | 10/1987 | Ting |
| 4,704,839 | A | | 11/1987 | Kay |
| 4,743,485 | A | | 5/1988 | Ting |
| 4,765,107 | A | | 8/1988 | Ting |
| 4,785,600 | A | | 11/1988 | Ting |
| 4,840,004 | A | | 6/1989 | Ting |
| 4,873,805 | A | | 10/1989 | Ting |
| 4,894,973 | A | | 1/1990 | Over |
| 4,949,506 | A | | 8/1990 | Durham, Jr. |
| 5,048,248 | A | | 9/1991 | Ting |
| 5,230,191 | A | * | 7/1993 | Mayrand |
| 5,247,770 | A | | 9/1993 | Ting |
| 5,325,579 | A | | 7/1994 | Baier |
| 5,412,922 | A | | 5/1995 | Vittori |
| 5,452,552 | A | | 9/1995 | Ting |
| 5,555,682 | A | | 9/1996 | Colitto |
| 5,596,851 | A | | 1/1997 | Ting |
| 5,598,671 | A | | 2/1997 | Ting |
| 5,664,392 | A | * | 9/1997 | Mucha |
| 5,687,524 | A | | 11/1997 | Ting |
| 5,836,133 | A | * | 11/1998 | Bergeron |
| 5,906,080 | A | * | 5/1999 | diGirolamo |

* cited by examiner

MULLION SPLICE JOINT DESIGN

FIELD OF THE INVENTION

This invention relates to section joints in supported section assemblies, specifically a joint design improvement to absorb significant deflections in mullion section supports while limiting mullion joint deflections to less than the deflections of the mullion section supports.

BACKGROUND OF THE INVENTION

A typical curtain wall panel assembly in a multi-story building consists of multiple wall panels supported by a number of laterally spaced apart, generally vertical mullion assemblies comprising a series of mullion sections spliced together in an end-to-end arrangement. Typically, the mullion section lengths are approximately equal to the height between adjacent floors of the associated building. Each erected mullion section is typically secured or anchored near an edge of an adjoining floor slab or other building support element that supports the mullion assembly and the associated curtain wall panels. Some of the functions of the erected curtain wall system are to provide a pleasing appearance and to provide a long term weather shield for the building interior against wind, rain, temperature, and other weather conditions.

Since each of the mullion sections are typically supported or anchored at the floor edges, floor movement or other deflection (e.g., under differential live loads) typically causes a comparable movement of the supports/anchors, mullions, and the curtain wall assembly. These movements, especially differential movements of floor edges of greater than about ⅜ inch or 1 cm, may adversely impact on the appearance of the curtain wall, disable the weather sealing functions, and could even cause structural failure of the curtain wall system and/or its components, such as the loss of panels and damage to the mullion assemblies.

The prior art solutions to this deflecting building floor and mullion support problem have included two design options. The first option is to design the curtain wall system to be structurally strong and/or compliant enough to absorb the differential inter-floor or other deflections. However, this option may lead to objectionable appearance, added cost, and/or long term weather shield performance problems, e.g., weather seals may not be able to reliably seal after repeated large joint compressions and expansions. The second option is to reduce the magnitude of the differential inter-floor deflection by stiffening the building floor supports/anchors. However, this option may not be feasible due to architectural limitations or treatment (e.g., a cantilevered floor slab design with thickness and material constraints) or may result in significant cost increases.

SUMMARY OF THE INVENTION

One embodiment of the present invention limits attached mullion section motion to within a tolerable range for a curtain wall assembly even when differential mullion support motions are outside the tolerable range. This is accomplished in an open gap embodiment by providing an open gap equal to or less than the tolerable range and prevent compressive relative displacement between mullion sections and allowing greater relative vertical displacements between a floor anchor and an adjoining mullion section. Thus, when floor deflections close the gap, further floor deflection causes an adjacent lower mullion section to provide support for the contacted upper mullion section that would otherwise move outside a tolerable range. Additional downward floor deflections beyond a tolerable range for the attached curtain wall assembly are allowed by a mullion support slot and a slidable connection. Thus, the adjacent floor continues moving downward and no longer supports the previously supported mullion section which is now supported by the lower mullion section.

In a preferred limited-gap embodiment, the splice gap between mullion sections may exceed the tolerable motion of the associated curtain wall panels, but a gap-limiting means is provided in addition to a slidable support. The gap-limiting means also provides support for a displaced mullion section (that would otherwise be displaced outside the tolerable range if supported by a displaced proximate floor anchor) by hanging on an above mullion section and/or being supported from a lower mullion section, allowing the dead weight of the supported mullion section(s) to be split among several other mullion sections and their associated supporting hardware. The preferred splice gap-limiting means comprises a gap containing a weather seal and a splice gap-limiting slot and sliding bolt connector where the gap-limiting bolt and slot limits relative up or down motions between mullion sections to acceptable levels for the curtain wall and weather seal. The preferred mullion support and joint assembly also includes a bearing support plate that can be field positioned using self-tapping screws avoiding the need for field drilling and/or welding.

BRIEF DESCRIPTION OF THE INVENTION

In these Figures, it is to be understood that like reference numeral refer to like elements or features.

DESCRIPTION OF THE PREFERRED EMBODIMENT OF THE INVENTION

Figure 1:
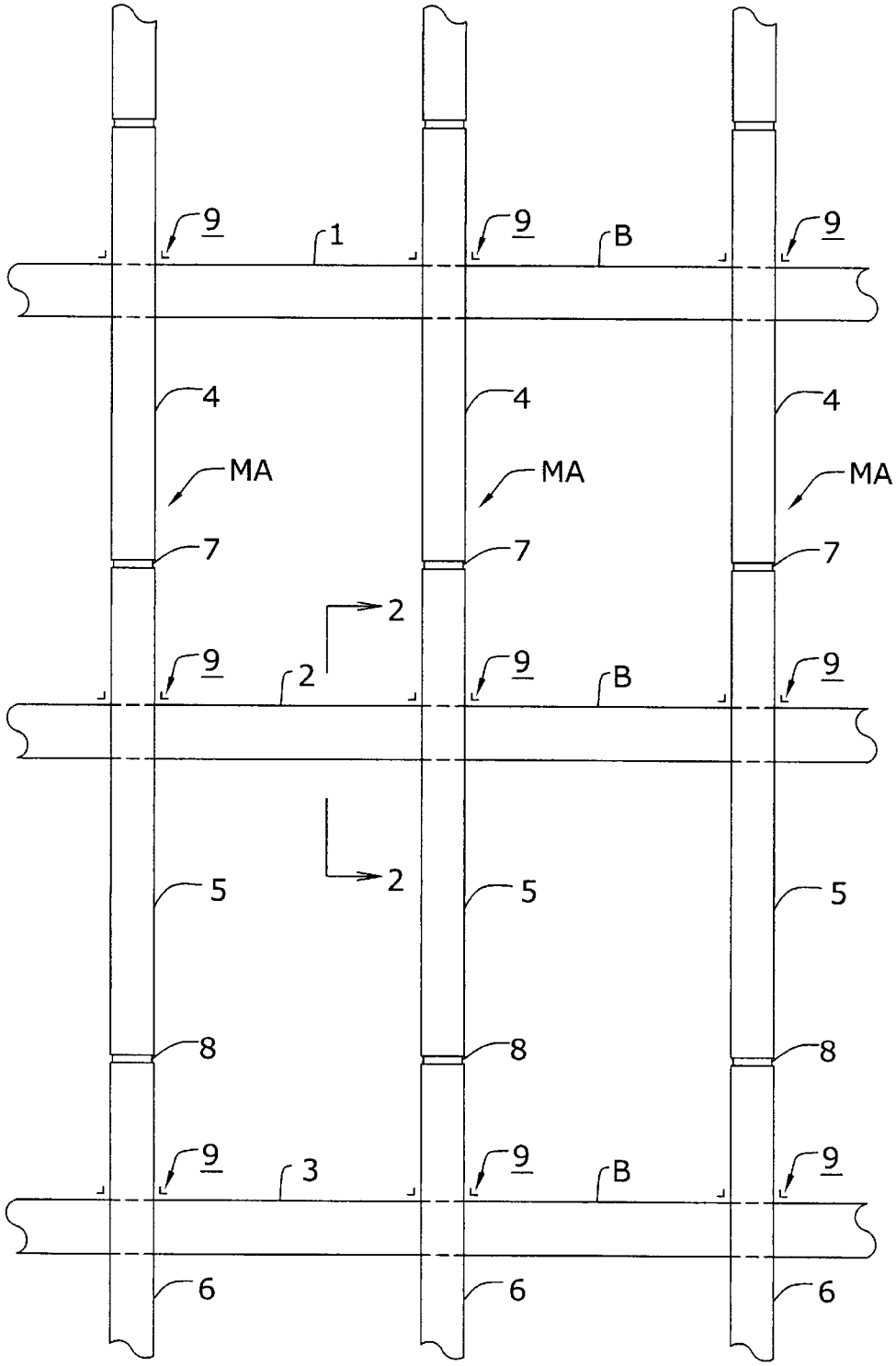
FIG. 1 shows a fragmental elevation view of a typical curtain wall mullion assembly covering three floors.

FIG. 1 shows a fragmental elevation of a portion of three typical mullion assemblies MA for supporting a portion of a curtain wall assembly in a multi-story building with floor embedded mullion anchors. In this embedded anchor embodiment of the invention, each portion of the generally vertical mullion assemblies MA shown includes spliced mullion sections 4, 5, & 6 placed end-to-end. Laterally adjacent mullion assemblies MA are identical in this embodiment, but alternative embodiments may use different adjacent mullion assemblies, such as assemblies using different splicing and attachment means for different curtain wall panels.

For the embodiment of the invention shown in FIG. 1, each of the spliced-together mullion sections 4, 5, & 6 are preferably each initially supported by an adjacent floor slab (e.g., floor slabs 1, 2, & 3) of a building B using anchoring assemblies 9. For example, the lower ends of the mullion sections 4 are spliced together with the upper ends of the mullion sections 5 to form a series of open-gap mullion joints 7. Similarly, the other ends of mullion sections 5 are spliced together with the mullion sections 6 to form a second series of open-gap mullion joints 8.

Figure 2:
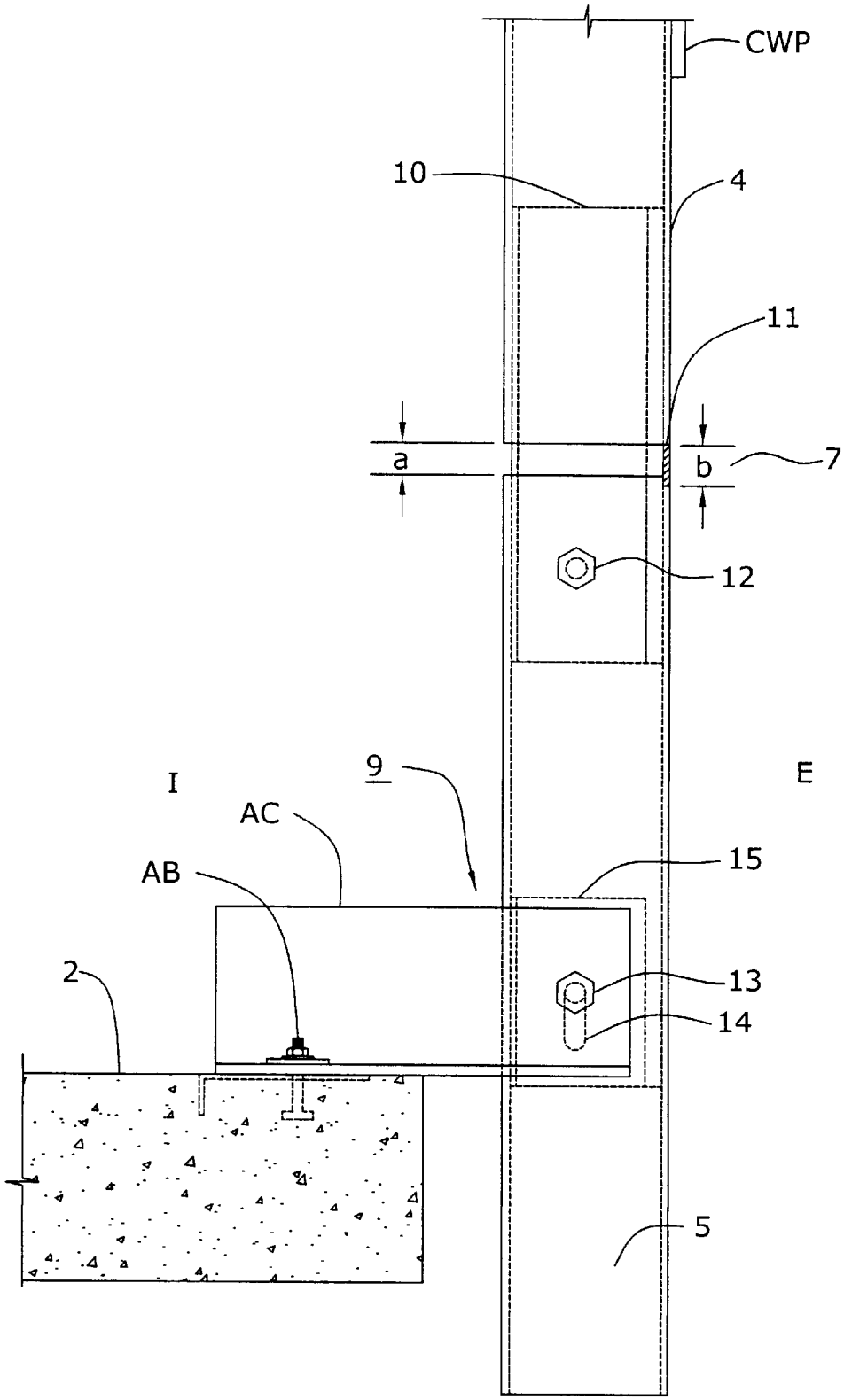
FIG. 2 is the cross-sectional view taken along line 2—2 of FIG. 1 showing a mullion connection and splice joint details of an imbedded floor-top anchor, open-gap embodiment.
Figure 6:
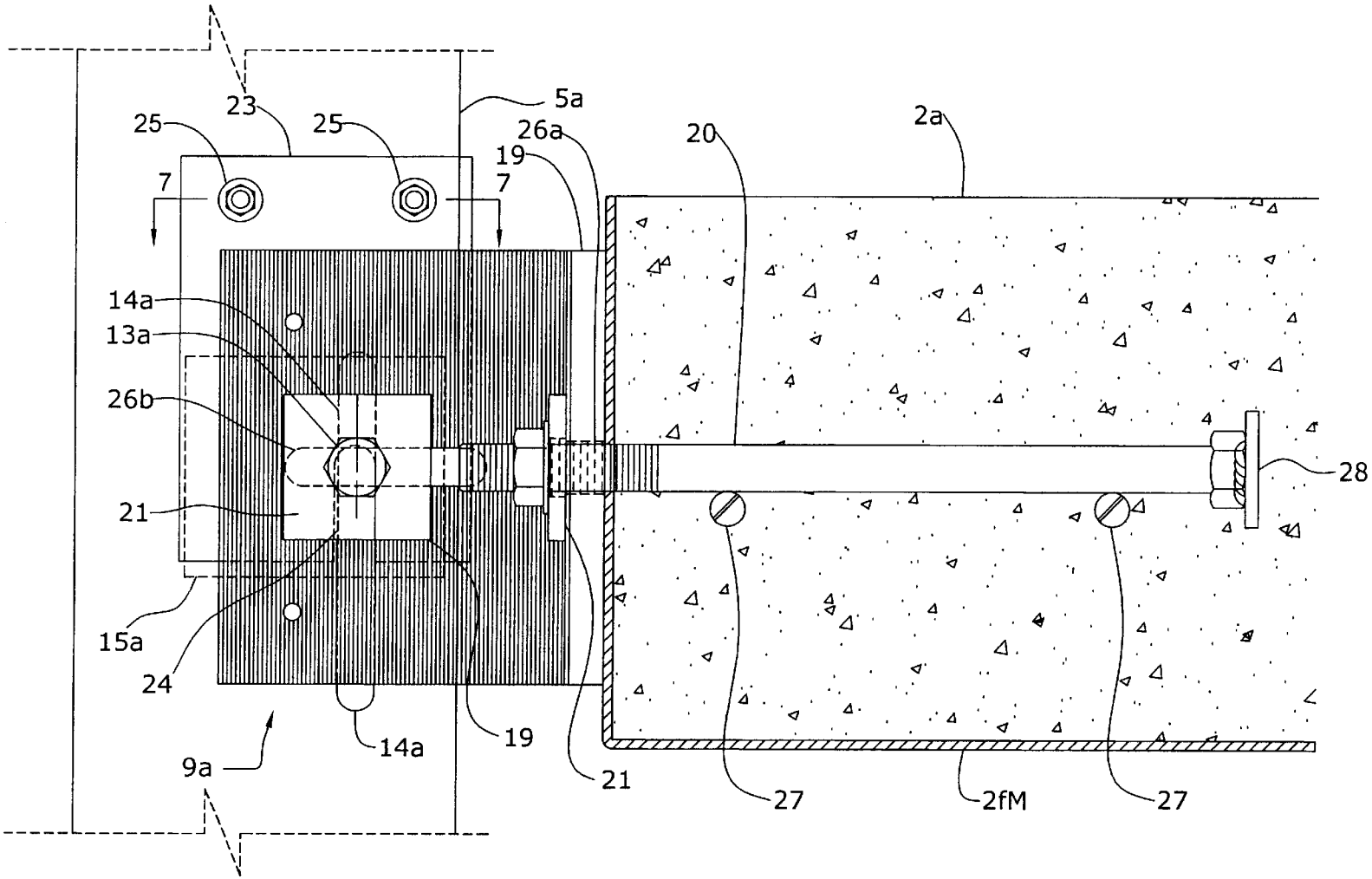
FIG. 6 is a cross-sectional side view of a slab side, limited gap embodiment of the invention.

A variety of other building anchoring devices may be used to support the mullion sections besides the anchoring assemblies 9 comprising top angle clips AC, floor-imbedded anchor bolts BA protruding upwards from the floor slabs 1, 2, & 3 as shown in FIG. 2, e.g., slab side anchors protruding outward from the floor slab as shown in FIG. 6, bolts attached steel spandrel beams of building B, or other anchors and structural supports. Although the preferred building anchor assembly includes a slab side anchor, angle clips 19, and sliding connector 13*a* as shown in FIG. 6, other embodiments of the invention can be readily adapted to other types, locations, and orientations of building anchor assemblies and structural supports.

Figure 3:
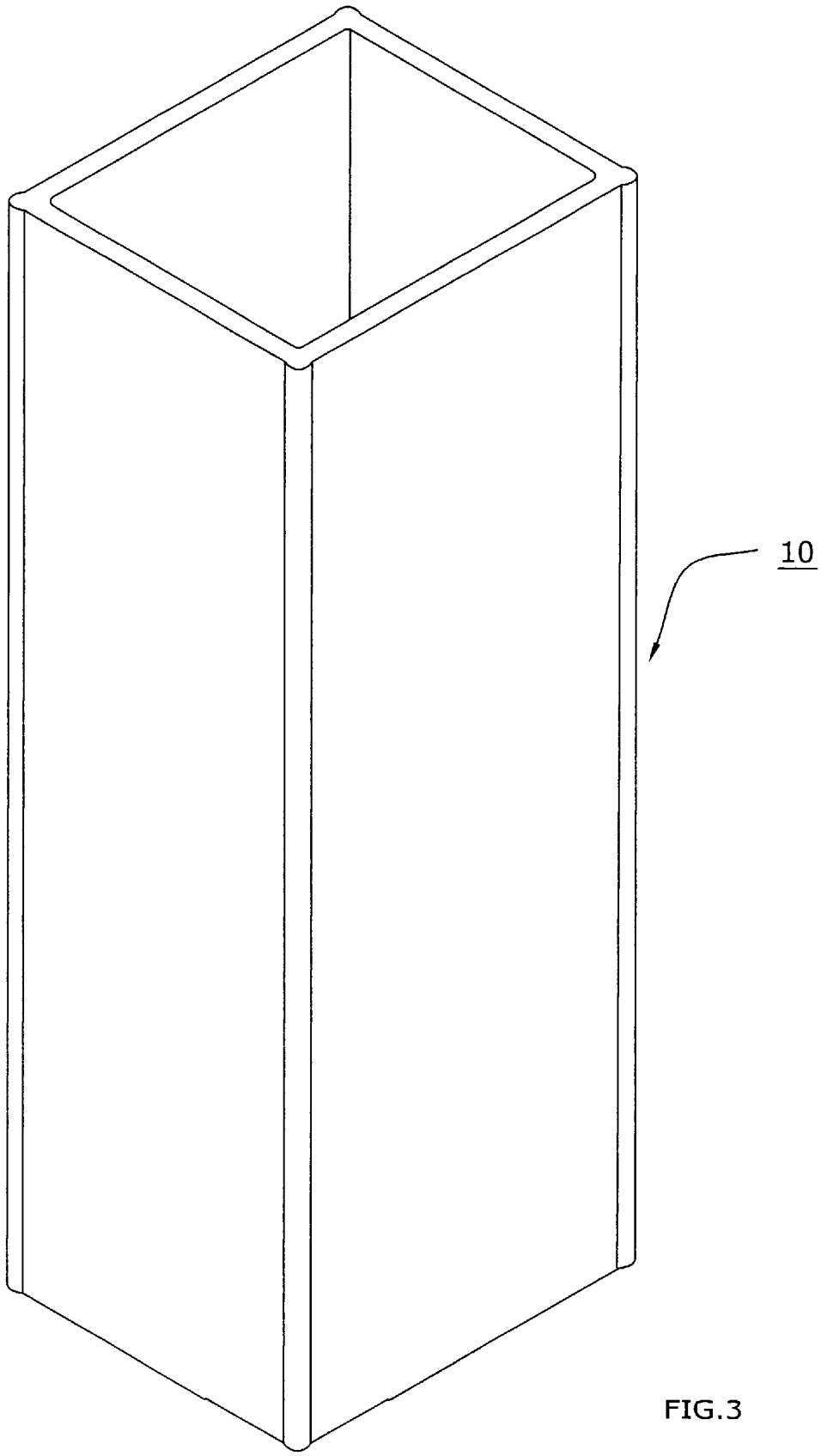
FIG. 3 is the isometric view of a mullion splice tube for the embodiment shown in FIG. 2.

FIG. 2 shows a partial cross-sectional side view taken along line 2—2 shown in FIG. 1. The mullion sections shown (e.g., mullion sections 4 and 5) typically support curtain wall panels CWP, only one of which is shown in FIG. 2 for clarity. The lower end of the mullion section 4 is spliced to an adjoining upper end of the mullion section 5 using a mullion splice tube 10 (as also shown in FIG. 3) and a splice tube fastener 12 bolted to the lower mullion section 5 to form the open-gap mullion joint 7. For the open-gap joint embodiment shown, the upper surface of the mullion section 5 is preferably notched (as also shown on FIG. 4) so that when the open-gap mullion joint 7 closes or has a zero interior gap dimension "a", an exterior gap dimension "b" is reduced, but is non-zero. Optional exterior gap dimension "b" is composed of the interior gap dimension "a" and an optional notch dimension "c" (see FIG. 4) on the upper portion of the exterior surface of mullion section 5.

In the embodiment of the invention shown in FIG. 2, an optional joint or weather seal 11 is located in the exterior gap "b" at the mullion joint 7. The weather seal 11 seals (in conjunction with curtain wall seals not shown for clarity) the interior building space I against the exterior weather environment E. Other embodiments of the open-gap joint assembly 7 can include two planar end surfaces of the spliced ends of mullion sections 4 and 5 spaced apart by gap "a" without the weather seal 11 or include a weather seal located between at least one mullion section and a modified splice tube. Still other open-gap embodiments of the invention can include a notched gap placed on a portion of an end surface of the mullion 5 other than the exterior portion, a non-planar end surface of an end of a mullion section configured as other than a notch, and having several notches and/or seals at the gapped joint 7 interface.

The preferred nominal dimension of the weather seal 11 (and the preferred nominal exterior gap dimension "b") is about two to three times the interior gap "a" dimension so that the weather seal will not be overly compressed when differential floor deflections or other mullion motions occur. The interior gap "a" may range from as little as about 0.1 inch (0.25 cm) or less to as much as about 1 inch (2.5 cm) or more. More preferably for the open-gap embodiment shown, the interior gap "a" is at least about 0.2 inches (0.5 cm) and less than about 0.5 inches (1.3 cm). These mullion open-gap dimensional limitations are typically chosen to limit the compressive motions of the attached curtain wall panels and seals to acceptable levels.

The exterior gap dimension "b" may range from as little as about 0.2 inch (0.5 cm) or less to as much as about 3 inches or 7.5 cm. More preferably for the embodiment shown, the exterior gap "b" is at least about 0.4 inch (1 cm) and less than about 1 inch (2.5 cm). The weather seal 11 is preferably field-applied silicone caulking, but flat rubber gaskets or other sealing materials and/or shapes may also be used.

Figure 11:
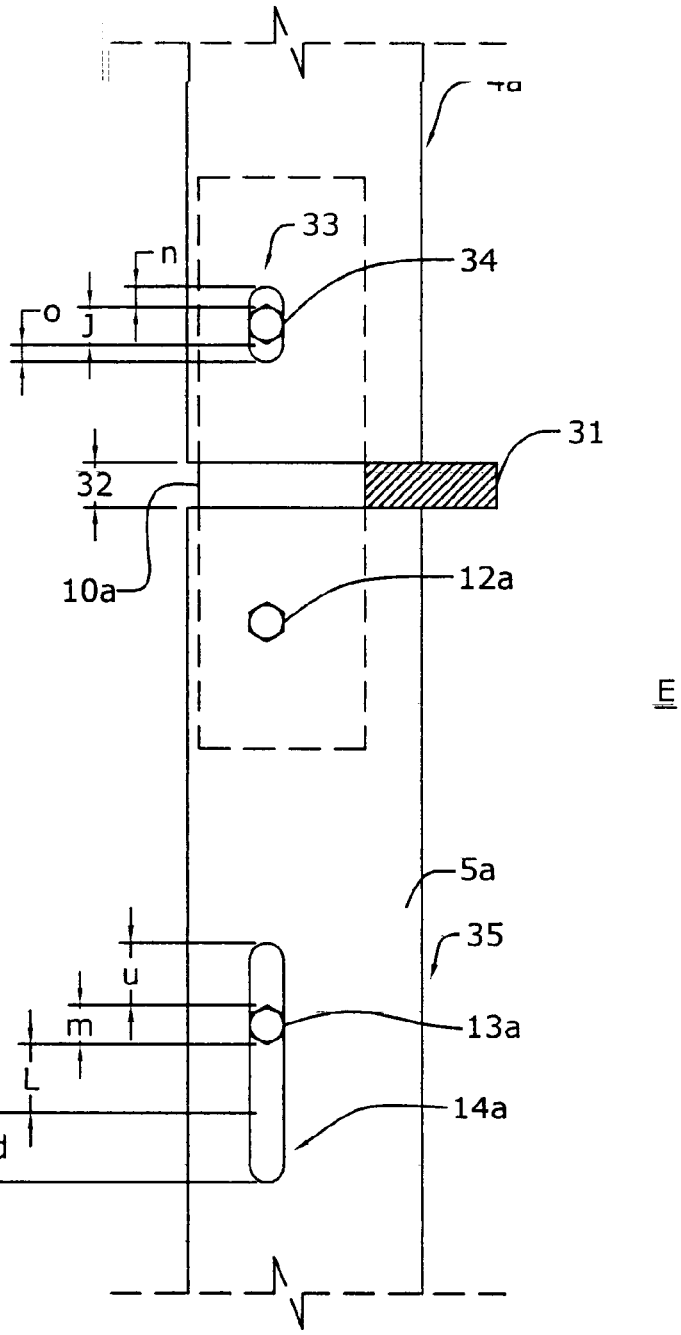
FIG. 11 is a simplified side view of a gap-limited splice joint during initial installation conditions.

In alternative embodiments, other means can be used to create the seal cavity effect of the dimension or step "c," such as notching the bottom end or both ends of the mullion sections. Still another method to create a seal cavity between mullion ends having a minimal height dimension "c" is to provide an axial motion blocker on the mullion splice tube 10 with straight cut mullion ends, e.g., a gap-limiting slot 34 and bolt 33 as shown in FIG. 11. Other motion blockers in alternative embodiments can include inward/outward upsets in the mullion and splice tube, fasteners such as screws protruding into the interior of a mullion proximate to the top of an adjacent splice tube 10, or a metal plate or block secured to a mullion section proximate to the top of an adjacent splice tube 10.

As shown in FIG. 2, the optional mullion splice tube or other mullion section protrusion 10 is preferably secured to the upper end of the lower mullion section 5 using a splice tube fastener 12 with the splice tube protruding beyond the top of the mullion section. The splice tube fastener 12 is preferably a self-drilling, self-tapping screw extending through the mullion section 5 and into the mullion splice tube 10, but clips, pins, bolts, adhesives, welding, and other fastening means can also be used in alternative embodiments. The preferred end protrusion or mullion splice tube 10 is composed of an aluminum alloy and has a rectangularly shaped cross-section sized to slidably fit inside the similarly shaped mullion sections 4, 5, & 6. However, circular, triangular, or other cross-sectional shapes may also be used for the protrusion 10 as well as end protrusions composed of other materials in other embodiments, such as a press-fit plastic insert fitted into the end of a mullion section that also avoids the need for a protrusion tube fastener.

In the imbedded floor anchor and open-gap embodiment shown in FIG. 2, mullion sections 5 are preferably slidably connected to the mullion anchoring assembly 9 using mullion connectors 13. Although the mullion nut and bolt connector arrangement shown in FIG. 2 is the preferred mullion connector 13 for the imbedded anchor bolt and anchor assembly 9 embodiment, other slidable mullion connectors can include mating male and female fasteners, screws, pins, clamps, clips, hooks, weldments, and shear plates. Although various anchoring assemblies and mullion connectors can be used in alternative embodiments, the preferred mullion anchor assembly 9 and mullion connector 13 allows the mullion sections 4, 5, & 6 to be field adjustable while limiting mullion and curtain wall deflections to tolerable levels, e.g., the connected or erected position of each building-supported mullion sections is selected to provide a open-gap joint within an allowable range of positions within the slotted holes, and the mullion sections to be slidable with respect to the mullion connector 13 in mullion slotted hole 14 allowing differential motion of the mullion connector and mullion section after the mullion section is prevented from further movement in one direction by contacting the adjoining mullion section. Besides the mullion having a relatively smooth sliding surfaces proximate to the slotted hole 14, the slidable function of the mullion connection can be achieved by avoiding excessive clamping forces from the mullion connector, e.g., only finger-tightening or loosely tightening the nut and bolt of connector 13, pinning the loosely tightened nut to the bolt, using interference threads on the nut and bolt and no overtightening, and using an upset on the threads to avoid tightening beyond the upset.

In the imbedded floor and open-gap embodiment of the invention shown in FIG. 2, the erected position of the mullion connector 13 is initially loosely fastened at the top of the mullion slotted hole 14. This position of the mullion connector 13 allows the dead weight of the mullion section 5 and the associated curtain wall portion to be hanging on the mullion connector and anchor assembly on the second floor 2. The configuration shown allows each mullion section 5 to fully support the associated portion of the curtain wall assembly of curtain wall panels CWP or other building facing elements when each end of the mullion section is separated from the adjacent mullion sections by the a nominal gap dimension "a" even though the connection is only loosely assembled. The nominal gap dimension "a" and open-gap joint 7 details shown in FIG. 2 typically apply to most of the other erected mullion sections and spliced end connections in the open-gap and imbedded floor anchor embodiment shown in FIG. 2.

In an alternative open-gap and embedded floor embodiment, the mullion connector 13 is assembled and tightened sufficiently to fasten the mullion section 5 to the anchor assembly 9 in the desired erected position, but not so fully tightened to prevent the mullion section from moving relative to the mullion connector 13 within the slotted hole 14 when forces sufficient to move the mullion section are applied.

With reference to FIGS. 1 & 2, significant differential inter-floor deflections between floor 2 and the adjacent floors can occur if minimal or no live loads are applied to portions of floors 1 and 3 near the edge shown while a substantial live loads are applied to the portions of floor 2 near the edge. Assuming no other dimensional changes (for example, due to thermal expansion), the maximum effect of these differential floor deflections on mullion section positions can occur in two stages. The first stage occurs when floor 2 is nominally deflected by a distance of up to about the gap dimension "a." For nominal deflections substantially within this allowable deflection of both the mullion/curtain wall and floor, the internal gap "a" of mullion joint 7 will be increased by a nominal distance "a" and mullion joint 8 will decrease until the bottom end of mullion section 5 will be nominally contacting (or bottomed out on) the top of mullion section 6 except at the exterior notch where optional air seal 11 will nominally be compressed to a dimension equal to "b" minus "a."

The second stage of load and position changes occur when floor 2 is nominally deflected by more than about the allowable gap dimension "a." In this second stage condition, the mullion connector 13 will slide or ride downwardly along the slotted hole 14 (and away from the floor-supported end) and at least a portion of the dead weight of the mullion section 5 & curtain wall portion previously supported by the second floor 2 will be transferred to the contacting mullion section 6. The position of the curtain wall portion supported by mullion section 5 will not be affected by further deflection of the second floor 2 beyond allowable dimension "a" assuming that the added load can be carried by the lower mullion section 6.

Although the nominal gap dimension "a" is preferably selected to also accept differential thermal expansion (e.g., between the aluminum mullion sections and the steel and/or concrete building structure) and other dimensional or tolerance variations may be considered in limiting mullion section motion, the major factor in setting the gap dimension in the open-gap embodiment is typically the curtain wall motion tolerance, i.e., it generally does not matter what factors are causing a mullion section to move outside the tolerable range of motion for the curtain wall assembly, the gap is selected to limit compressive motion between adjoining/spliced mullion sections. For example, maximum differential floor deflections under live and no load conditions (for adjacent floors) can typically range from about ⅜ to 1 inch (or about 1 to 2.5 cm) or more for some commercial buildings whereas a range of expected differential thermal expansions between floors would typically be orders of magnitude smaller. But no matter what causes the differential motion, the preferred open-gap embodiment of the invention limits nominal compressive movements between adjacent mullion sections to the interior gap dimension "a," preferably to within a range from about ⅛ to ½ inch (or about 0.3 to 1.3 cm). More preferably for the open-gap embodiment, interior gap "a" ranges from about ¼ to ⅜ inch (0.6 to 1 cm).

If the maximum expected inter-floor deflection is n times the tolerable curtain wall deflection or interior gap "a," then the nominal maximum dead load accumulation on a lower, undeflected mullion anchoring assembly 9 would be about n floors. Therefore, in the design of a mullion section and a mullion anchoring assembly 9, the dead load of the mullion sections and associated curtain wall assembly portions for "n" floors should be considered. If the probability of a maximal differential live loading between adjacent floors or a series of floors is small enough and the adverse curtain wall impacts of mullion motions beyond the limiting gap "a" dimension can be accepted under these low probability events, the design loads can be reduced to something less than for the dead loads of mullion sections and associated curtain wall assembly portions for n floors.

The cost impact of any additional wind or dead load that must be supported by a mullion section and anchor assembly if gap "a" dimension closes is typically minor. The slotted hole 14 and connector 13 can transfer lateral winds to the adjoining floor even if dead loads are not supported by the associated floor. The portion of the mullion splice tube 10 protruding into the adjacent mullion section continues to transfer the wind load reaction at this location even during maximal deflections, preventing point contact for the wind load reaction. Since the wind load is substantially independent of the position of any one mullion section, the cost impact of the potentially extended length of a splice tube 10 is typically minor.

Although the mullion connector 13 can slide within the slotted hole 14 and adjoining floor no longer supports a maximally deflected mullion section, the cost impact of the added dead load capability is also typically minor since design wind loads are normally the major or controlling factor in the design of the strength of any mullion and mullion anchoring assembly 9. In other words, in order to provide the strength to resist wind loads at the mullion connector 13 and anchor assembly 9, the typical design will inherently also resist the multiple dead loads of several mullion sections and the associated curtain wall portions supported by the mullion sections.

FIG. 3 shows an isometric view of the mullion splice tube 10 for the open-gap embodiment shown in FIG. 2. The cross-sectional dimensions of the splice tube 10 should preferably allow a tight but slidably fit inside the mullion sections 4, 5, & 6, but clearances of as much as about 0.25 inch (0.6 cm) or more are possible. The length of the mullion splice tube can vary significantly, but preferably should be at least about 4 inches (10 cm), more preferably at least about 2 inches (5 cm) so that it protrudes into the adjoining mullion section under a variety of deflection conditions. As shown in FIGS. 2 & 3, the splice tube 10 is composed of an aluminum alloy, allowing self-drilling & self-tapping screws 12 to secure the splice tube to a mullion section without pre-drilling the splice tube. In an alternative embodiment, the adjoining ends of the mullion sections are positioned to be spaced apart by gap "a" without the need for a splice tube 10 if the splice tube is not required for wind load transfer, alignment, or other reasons.

Figure 4:
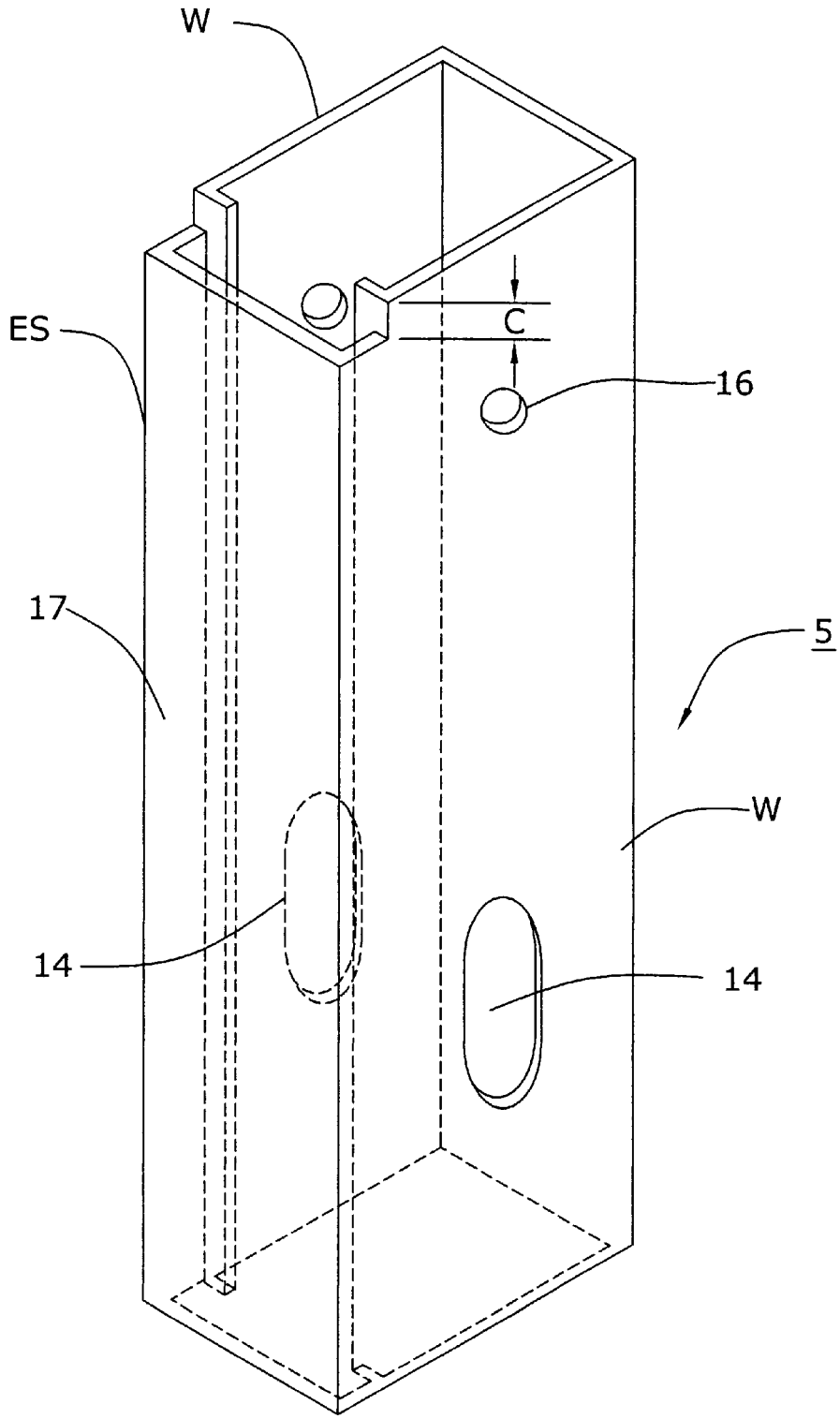
FIG. 4 is the isometric view of a mullion section for the embodiment shown in FIG. 2.

FIG. 4 shows an isometric view of the open-gap embodiment of mullion section 5 shown in FIG. 2. The exterior surface ES of the mullion section 5 includes a mullion flange 17 that has a step notch near an upper end having a depth dimension "c." The notch depth "c" is equal to the nominal dimension "b" minus "a" shown in FIG. 2. Depth "c" preferably ranges from about ⅛ inch (0.3 cm) to 1 inch (2.5 cm), more preferably from about 0.25 inch (0.6 cm) to 0.5 inch (1.3 cm), but other dimensions are also possible depending upon seal 11 design and other application factors.

The splice tube fastener holes 16 (shown in FIG. 4) on the sides or webs W of mullion 5 are provided for the splice tube fastener 12 or means for attaching a splice tube 10 as shown in FIG. 2. In alternative embodiments, other means for attaching a splice tube 10 to the mullion section 5 can be used to avoid the need for the splice tube fastener holes 16, e.g., a press fit of the splice tube into a mullion section. The slotted holes 14 on the mullion webs W are preferably provided to allow the mullion connector 13 to slide in a generally up and down direction, see FIG. 2. However, in alternative embodiments, the slotted hole 14 shown in FIG. 4 may have different shapes or orientations. Other means for slidably connecting a structural support to a mullion section may avoid the need for a slotted hole 14 in still other embodiments of the invention, e.g., mating protrusions in a support member and mating grooves in a mullion section. In another alternative embodiment, the splice tube 10 is replaced with a flexible connector or other expandable/contractible material having sufficient structure to transfer expected wind or other loads.

The exterior flange 17 with exterior surface ES is provided as the location for attaching the curtain wall panels CWP (see FIG. 2) and associated assembly hardware. However, the shape and form of exterior flange 17 can be modified to adapt to many different curtain wall systems in other embodiments of the invention.

Figure 5:
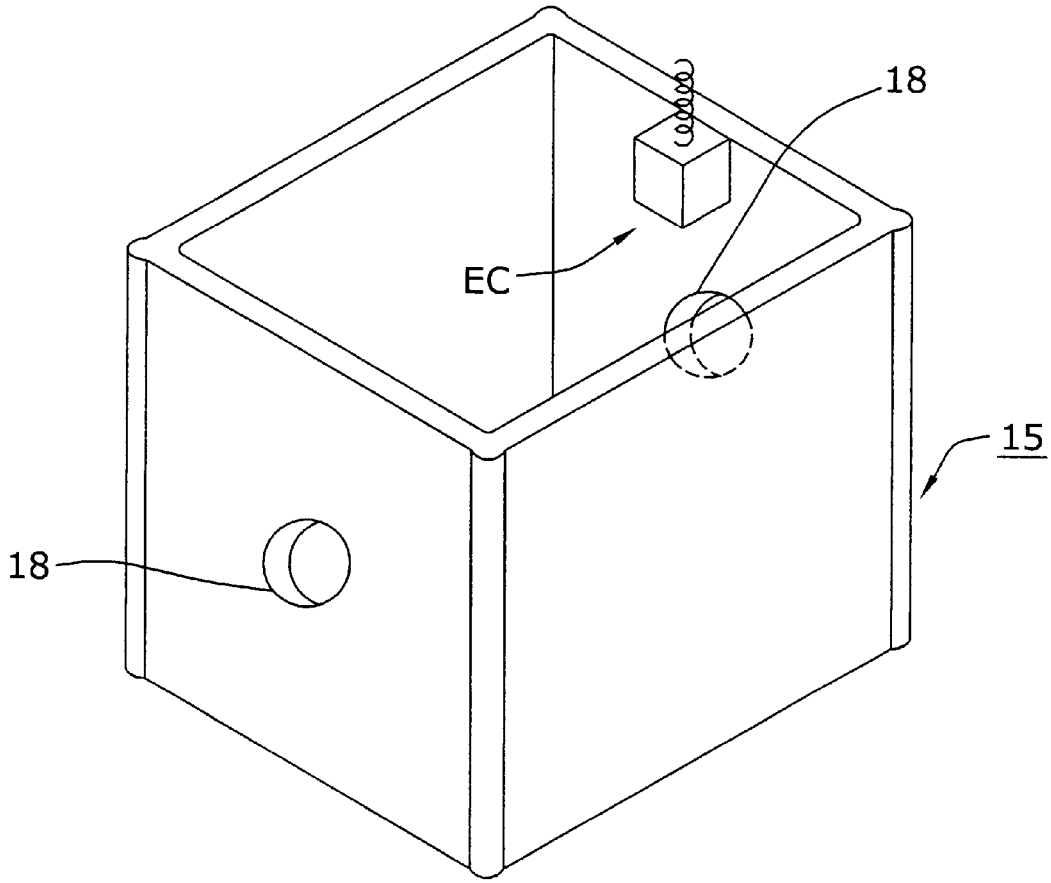
FIG. 5 is the isometric view of a short piece of the mullion splice tube for the embodiment shown in FIG. 2.

FIG. 5 shows an isometric view of a mullion support tube 15 with the mullion bolt holes 18 used in conjunction with the mullion connector 13. The cross-sectional dimensions of the mullion support tube 15 preferably allows the mullion support tube to slide within the interior of a mullion section to help transfer wind load reaction from the mullion to the mullion connector 13, but alternative embodiments can include interference fit (with a slotted hole instead of the mullion bolt hole shown) or larger clearances, e.g., on the sides not supporting wind load transfer. The overall length of mullion support tube 15 is typically about 3 inches (7.5 cm), but can be altered in other embodiments if wind or other load transfer considerations allow or require it.

An alternative embodiment of the invention avoids the need for a mullion support tube 15 if sufficient strength is available in the mullion sections and anchoring assemblies 9 shown in FIG. 2. For example, this may be achieved using larger diameter or multiple connectors 13.

FIG. 6 shows side cross-sectional view of another embodiment of the invention, a limited-gap embodiment instead of an open gap embodiment previously described. The limited-gap embodiment shown in FIG. 6 is supported from slab-side anchors 20 instead of the imbedded floor bolts BA and top anchors AC shown in FIG. 2. The side cross-sectional view of FIG. 6 is taken at the location of a slab side anchor 20 and is oriented at a different side of a building and floor 2*a*, but is otherwise generally similar to the view shown in FIG. 2.

The gap-limited embodiment of the invention shown in FIGS. 6–12 may be somewhat more costly than the open-gap embodiment shown in FIGS. 1–5, but has advantages as later described. Although not required for all applications of a gap-limited embodiment, the slab-side anchor bolt or assembly 9*a* that protrudes outwardly from an alternative floor slab 2*a* is also a typical application of the invention in addition to the upwardly directed, floor imbedded anchor bolt and assembly 9 as previously shown and described. Although the slab-side anchor assembly 9*a* is also typically imbedded in a concrete floor slab 2*a*, additional rebar 27, straps 28, or other structural reinforcements of the anchor assembly is also typically placed in the concrete floor slab in order to resist the dead load and wind load reactions.

FIG. 6 shows one of two slab-side angle clips 19 supporting a mullion section 5*a*, the angle clips secured to the side of floor slab 2*a* using side anchor bolt 20. The interior faces 19*a* and 19*b* of the angle clips 19 are serrated (see FIG. 7) to match the serrations of a serrated compression plate 21 shown in FIG. 6. After a serrated compression plate 21 is placed against and/or compressed onto one face of the angle clips 19, e.g., by finger-tightening a side anchor nut 22 (see FIG. 7) onto the side anchor bolt 20, motion across the serrations is essentially prevented even if the side anchor nut is not fully tightened.

The angle clips 19 preferably support and secure the mullion section 5*a* by means of a mullion nut and bolt or other connector 13*a*, one or more serrated compression plates 21, one or more bearing plates 23, and an optional mullion support tube 15*a*. The mullion slotted hole 14*a* allows relative vertical movement between the mullion 5*a* and the angle clips 19 similar to the function of the slotted hole 14 shown in FIG. 2. The bearing plate 23 includes a bearing slot 24 which is preferably placed such that, after the bearing plate is attached to the mullion section 5*a*, the mullion connector bolt 13*a* is initially located at the interiormost position in the bearing slot with the bearing slot opening SO (see FIGS. 10 and 6) facing downward. This location and orientation of the bearing plate 23 and the sliding ability of the connector 13*a* allow the mullion bolt 13*a* to initially fully support the mullion section 5*a* and associated panels through the bearing plate 23, angle clips 19 and side anchor 20, but also allows the absence of full support at this point if the mullion connector moves downward relative to the mullion section 5*a* shown in FIG. 6. The bearing plate 23 is secured to the mullion section 5*a* by means of several bearing plate screws 25. The bearing plate screws 25 are preferably self-drilling and self-tapping screws, such that a separate step or steps of field drilling and tapping into the mullion section 5*a* are not required. Alternative embodiments of the invention can attach the bearing plate 23 to the mullion section 5*a* using other attachment means, such as weldments, adhesives, serrated mating surfaces, pins, or bolts.

Figure 8:
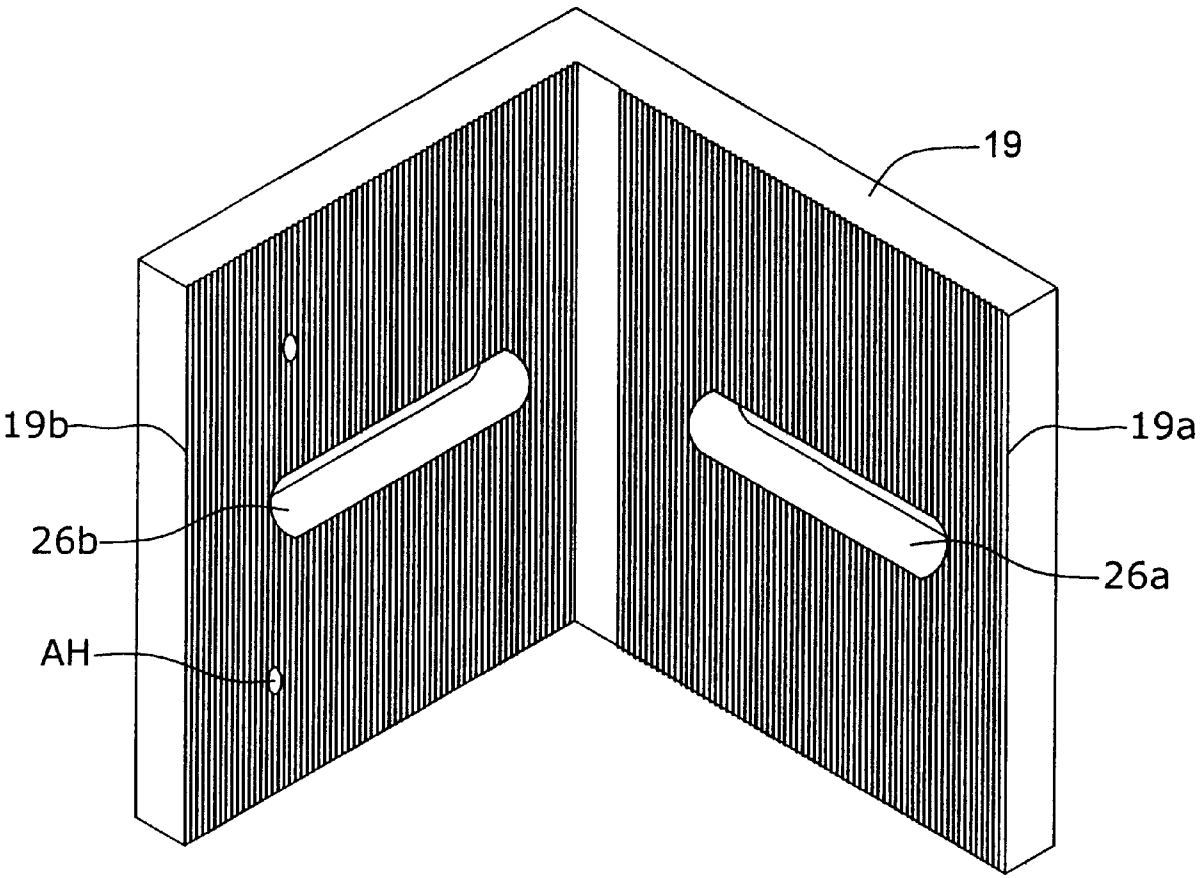
FIG. 8 is an isometric view of the serrated clip of the embodiment shown in FIG. 6.

The angle clips 19 also have at least one slotted hole, preferably two slotted holes, an in-out slotted hole 26*b* and left-right slotted hole 26*a* (also see FIG. 8). The in-out slotted hole 26*b* and slidable bolted connections allow adjustment of the in and out position (relative to building floor 2*a*) of mullion section 5*a* after being loosely positioned on top of a lower mullion section. The left-right slotted hole 26*a* similarly allows adjustment of the left and right position of mullion 5*a* after being loosely positioned and connected to the angle clip 19. The slotted holes 26*a* and 26*b* also allow some amount of rotational positioning of a mullion section in two planes although the preferred position is substantially vertical. Once a mullion section is in position, mullion connector 13*a* is finger tightened such that the serrated compression plate 21 engages the serrations and the angle clip 19, preventing further in and out and left or right movement, but allowing relative vertical motion between the floor slab 2*a* and mullion 5*a*, initially restricted to relative downward motion of the floor slab 2*a* by the bearing plate 23 and the initial contacting position of the bearing plate slot 24.

Figure 7:
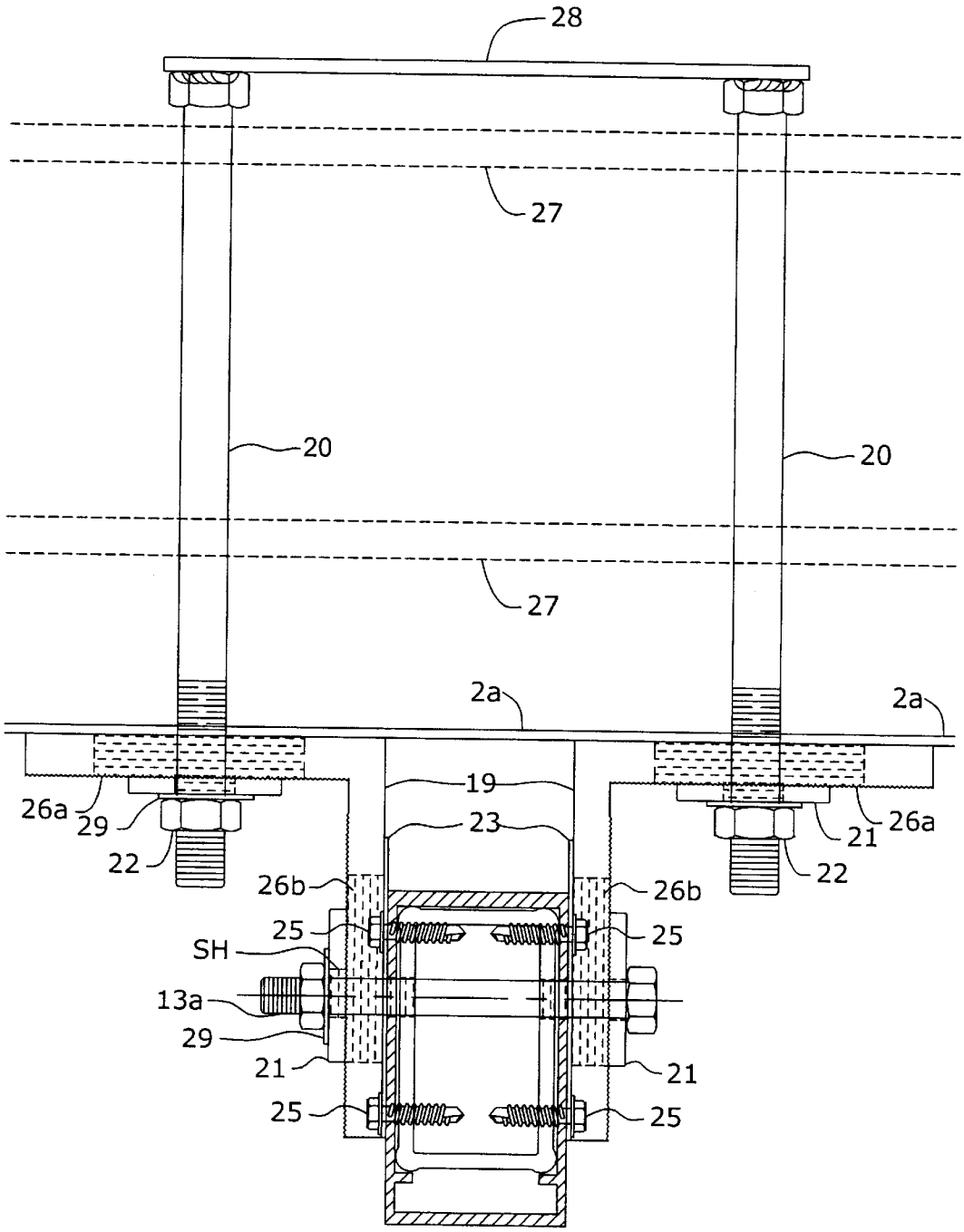
FIG. 7 is a cross-sectional top view of the slab side, limited gap embodiment shown in FIG. 6 along line 7—7.

FIG. 7 shows a top cross-sectional view at 7—7 shown in FIG. 6 across a mullion section at screws 25 looking down at a floor slab 2*a* and the limited-gap embodiment attached to the floor slab. The slab-side anchor bolts 20 are imbedded in the concrete floor slab 2*a* and positionally reinforced by rebars 27 and the strap 28. After the dead weight of the mullion section 5*a* is temporarily supported (for example, using shims at gapped mullion joints as shown in FIG. 11), the bearing plates 23 are positioned and secured to the mullion section 5*a* with the bearing plate screws 25 such that the dead weight of the mullion section can be supported by the floor slab 2*a* after the temporary support of the mullion section is removed.

The mullion support tube 15*a* is similar to the optional mullion support tube 15 in the embodiment of the invention shown in FIG. 1 and serves similar functions. In the embodiment shown, the mullion support tube 15*a* moves with the mullion connector 13*a* relative to the mullion section 5*a*, but alternative embodiments may allow relative motion between the mullion support tube 15*a* and connector 13*a* as previously described for the support tube 15 of the open gap embodiment.

The anchor nuts 22 secure washers 29 and serrated compression plates 21 to the angle clips 19 at the left-right slots 26*a* after the dead weight of the mullion section 5*a* is supported and the mullion section is in the desired left-right position. The mullion connector 13*a* secures the washers 29 and the serrated compression plate 21 to the angle clips 19 at the in-out slots 26*b*.

FIG. 8 is an isometric view of an angle clip 19 having serrated interior surfaces 19*a* and 19*b*. The serrations on the serrated surfaces 19*a* and 19*b* are oriented generally perpendicular to the elongated slots 26*a* and 26*b* such that when the serrations on the serrated compression plate 21 (e.g., see FIG. 9) are engaged with the serrations on the interior surfaces 19*a* and 19*b*, relative motion of a bolt within these elongated slots is substantially prevented.

Screw holes AH are also optionally provided on at least one of the serrated surfaces 19*b*. The screw holes AH may be used for fixing the angle clip 19 directly into the mullion 5*a* supplementing or instead of using the bearing plates 23 and the bearing plate screw 25, e.g., if the interfloor deflection is less than or equal to dimension "a" as shown in FIG. 2. The screw holes AH may also be used for alignment or other purposes.

In alternative embodiments, multiple tongue-in-grove slots, tracks with mating pins, or other means for adjustably positioning the mullion sections in one or two planes may be used instead of the bolts in elongated slots 26*a* and 26*b* with mating serrations on an angle clip 19 and compression plate 21. Other means for adjustably securing the positioned mullions can include clamps, adhesives, or tack welds.

Figure 9:
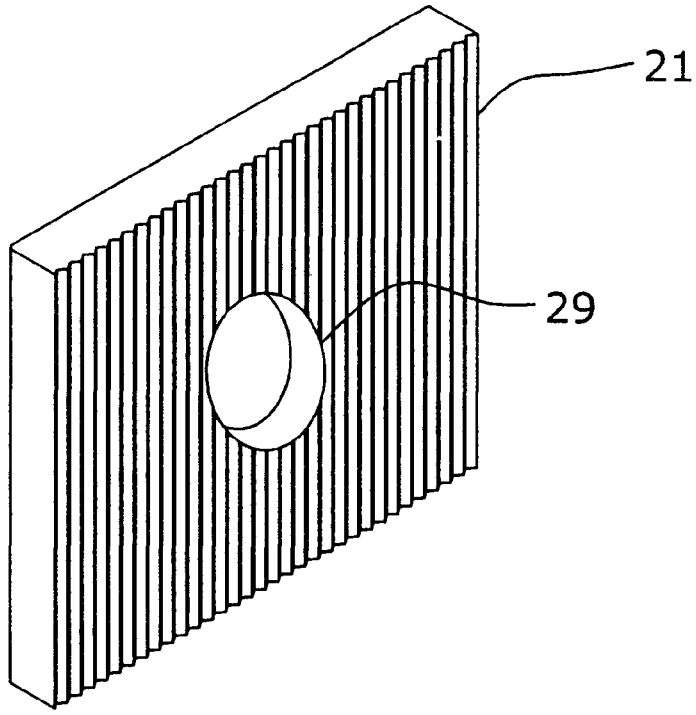
FIG. 9 is an isometric view of the serrated compression plate of the embodiment shown in FIG. 6.

FIG. 9 is an isometric view of a serrated compression plate 21. The serrations preferably match the serration pattern of the interior surfaces 19*a* and 19*b* of the angle clip 19 shown in FIG. 8, but alternative embodiments may use other means for restraining relative motion in a direction along the length of an elongated slot 26*a* or 26*b* as shown in FIG. 8, e.g., protrusions and mating recessed groves, roughened mating surfaces, glue or other adhesives, tack welding, or self-tapping screws. Serration hole 29 allows passage of the mullion connector 13*a* as shown in FIG. 7. The serrated compression plate 21 is preferably composed of steel or other relatively strong structural material in order to limit the plate size, but alternative structural materials may also be used.

Figure 10:
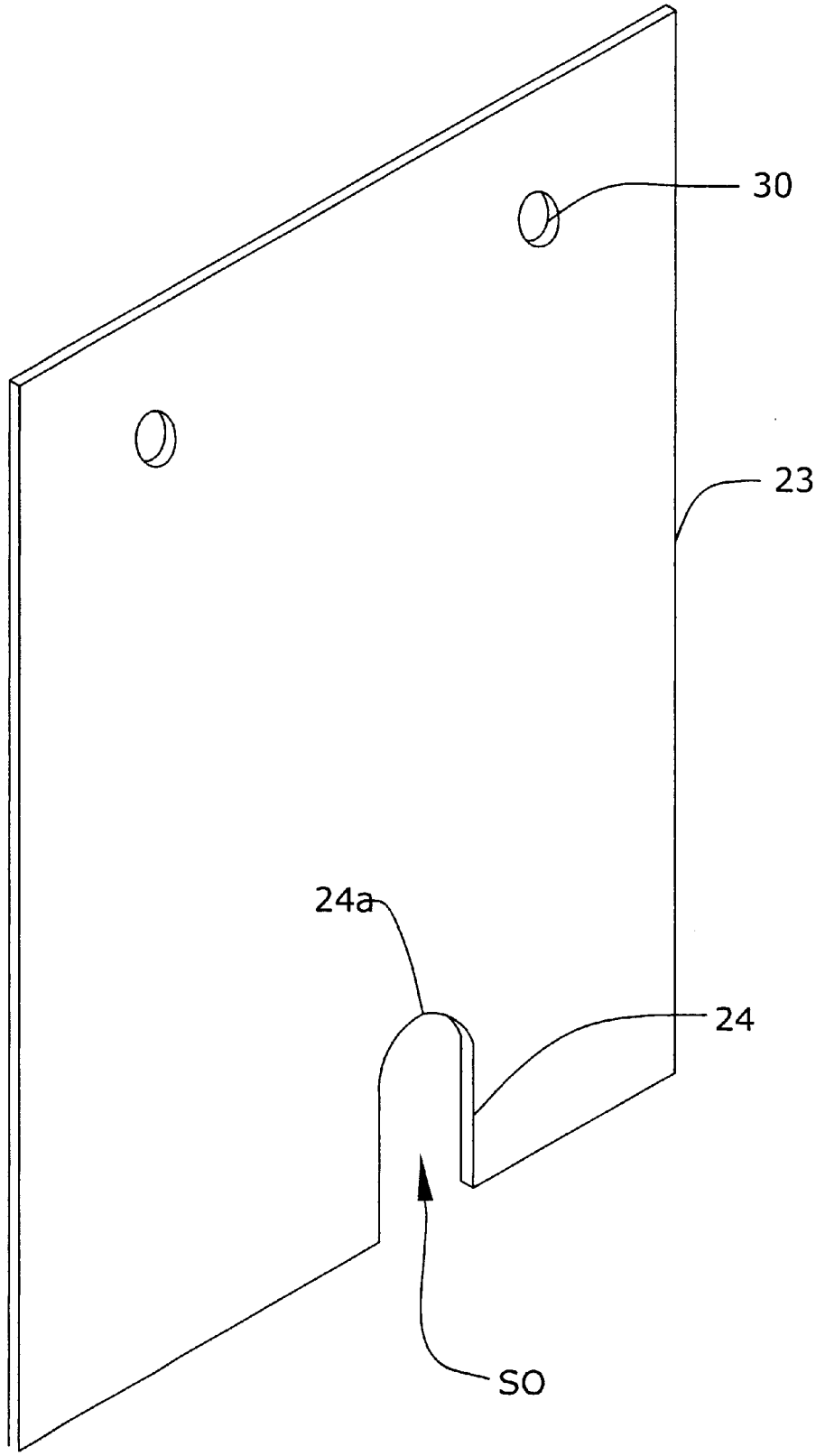
FIG. 10 is an isometric view of the load bearing plate of the embodiment shown in FIG. 6.

FIG. 10 is an isometric view of a bearing plate 23. Preferably, the bearing plate 23 is shop fabricated with screw holes 30 and a bearing plate slot 24. As shown in FIGS. 6, 7, and 10, the bearing plate 23 and bearing plate slot 24 are preferably selected to support the loads of the mullion section 5*a* and associated curtain wall panels by transferring that load from the screws 25 and screw holes 30 to the innermost portion 24*a* of the bearing plate slot 24 and the mullion connector 13*a*. The bearing plate 23 is preferably composed of steel, but other structural metals or materials may be used in alternative embodiments. In other alternative embodiments, additional screw holes 30 and/or plate slots 24 can be added or alternative means for attached the bearing plate 23 to a mullion section may be provided.

FIG. 11 show a vertical cross-sectional view taken along the surface of the webs of mullion sections 4*a* & 5*a*, showing a limited-gap joint 32 between mullion sections 4*a* and 5*a* in an initial assembly position. The mullion section 4*a* is temporarily supported by shim 31, which is in turn temporarily supported by the lower mullion section 5*a* in this initial assembly position. The thickness of the shim 31 is nominally the desired limited-gap dimension 32 which can be similar to open-gap exterior dimension "b." The shim 31 is preferably composed of steel, but alternative embodiments may be composed of aluminum, wood, plastic, fiberglass or other structural materials. The shim 31 is preferably at least about 0.2 inches (0.5 cm) thick and preferably less than about 1 inch (2.5 cm) thick, but the thickness of the shim 31 as well as the nominal opening dimension of the limited gap splice joint 32 may vary widely with the selection of optional weather seals in the gap joint (not shown for clarity, but similar to the weather seal 11 shown in FIG. 2) and curtain wall panel displacement tolerance variations (see curtain wall panel CWP in FIG. 2). The more preferred thickness of shim 31 (and nominal gap dimension 32) is about 2 to 3 times the dimension of the maximum bottom closing dimension o of the splice slot 33 if a weather seal is placed in the limited-gap dimension 32. In an alternative embodiment, the shim 31 is composed of a sealing material and is left in place after initial assembly to become a weather seal comparable to the weather seal 11 shown in FIG. 2.

The limited-gap joint 32 is formed by the adjoining ends of mullion sections 4*a* and 5*a*, preferably between two proximate planar end surfaces of mullion sections 4*a* and 5*a* rather than the notched mullion ends shown in FIG. 2. After the shim or spacer 31 is removed, a field-applied caulking of seal similar to weather seal 11 shown in FIG. 1 is preferably placed in the limited-gap joint 32. However, alternative embodiments of the invention may use a gasket seal contacting all end surfaces (instead of just the exterior surface shown in FIG. 2), putty or other gap fillers, seals in different locations, non-planar mullion ends, or other geometries at the limited-gap splice joint 32.

The gap-limiting slot 33 in the upper mullion section 4*a* is preferably sized to accept the nominal diameter f of the gap-limiting fastener or protrusion 23 (attached to the splice tube 10*a*) plus a nominal limited-gap opening dimension o and limited-gap narrowing dimension n. Thus, the overall nominal length of the gap-limiting slot 33 is approximately equal to sum of all three dimensions o, f, and n. The limited-gap fastener 34 is preferably a bolt having a nominal diameter f of about 0.75 inches or less. The gap opening dimension o and the gap narrowing dimension n preferably range from about 0.1 inches (0.3 cm) to about 0.5 inches (1.3 cm), most preferably with nominally equal opening and narrowing dimensions of about ⅜ inches (1.0 cm) or less. The limited-gap splice tube 10*a* is similar to the splice tube 10 shown in FIG. 2, the limited-gap splice tube fitting within the internal opening dimensions of the mullion sections 4*a* and 5*a* that also provides a space for the shim 31 at the exterior flange 35 of the mullion sections 4*a* and 5*a* facing towards the exterior environment E.

The limited-gap mullion connector 13*a* is shown in the nominal center position in mullion slotted hole 14*a* in FIG. 11. The nominal length of the mullion slotted hole 14*a* is preferably composed of the diameter m of the mullion connector 13*a*, a nominal floor tolerance u, lower tolerance l, and a maximum net differential deflection md, where the maximum net differential deflection md is equal to a maximum interfloor deflection less the dimensions of the allowed limited-gap deflection (and allowed curtain wall motions) n or o. The nominal dimension for the upper tolerance u is about 0.5 inches or less (1.3 cm), the lower tolerance l is about 0.5 inches or less (1.3 cm) and the nominal net differential deflection dimension md can be about 0.625 inches (1.6 cm) or more, thus the nominal overall length of limited-gap slot 34 is about 2 inches (5 cm) or more.

The mullion slotted hole 14*a* is provided to accept positional variations and relative motion between the connector 13*a* and mullion section 5*a* caused by the vertical floor erection tolerance (dimensions u and l) and the amount of the interfloor deflection exceeding the maximum allowable curtain wall joint movement, dimension md. The gap-limiting slot 33 is provided to limit the maximum mullion joint movement (dimensions n and o) to be less than or equal to the maximum allowable curtain wall joint movement. This preferred nominal dimensioning of the gap-limiting slot 33 assures that floor erection tolerances and deflections under load (typically larger that curtain wall deflection tolerances) will not cause larger than maximum allowable curtain wall joint movements.

FIG. 11 shows the nominal location of bolts in relation to the slotted holes 14*a* and 33, but the actual initial location of the bolt 13*a* can ranges within the l+m+u dimensions of slot 14*a*. Splice tube bolt 12*a* fixes the position of the splice tube 33 to the top of the lower mullion section 5*a*. The gap-limiting bolt 34 is fixed to the splice tube 10*a* but can slide along the gap-limiting slot 33 on the upper mullion section 4*a*. After removal of the shim 31, the relative floor downward movement (and movement of attached connector 13*a* initially supporting the mullion section 5*a* and associated curtain wall panels) beyond tolerable curtain wall deflections will nominally cause a gap-limiting bolt attached to a mullion section below mullion section 5*a* to top out in the mating gap-limiting in mullion section 5*a* 33 (and the loads carried by the lower mullion section 5*a* potentially to be supported mullion below 5*a*) and the gap limiting bolt 34 to bottom out in the gap-limiting slot 33 and some of the loads previously supported by mullion section 5*a* to be supported by or hung on the upper mullion section 4*a*. Thus, no matter how much excessive floor deflections are encountered, the maximum mullion gap joint movement is always within about +n and −o dimensions.

If the n and o dimensions are equal, the nominal support slot design requirements for a maximum floor deflection, mfd, should be equal to about the md plus n (or o) dimensions. The maximum loads (including dead weight and wind loads) to be supported at any one floor (and the associated side anchor bolts) is equal to the maximum load at any one floor times a multiplier factor mf equal to md/n (rounded up to the next highest integer) plus one. For a large degree of safety, the mullion to mullion connection at bolts 13*a* and 34 should be designed to withstand a tension or a compression load equal to the dead weight of the curtain wall on the mullion for mf floors. The mullion to floor slab connection and support elements should be designed for the combination of wind load reaction (in a generally horizontal direction that is not otherwise laterally supported at each floor) and dead load reaction in a generally vertical direction for mf floors of mullion sections and curtain wall assembly weight on a mullion section. For example, if the maximum interfloor deflection is about one inch and the maximum allowable curtain wall joint movement is about 0.375 inches, n (and o) dimensions would be about 0.375 inches, md dimension would be equal to 1 minus 0.375 or about 0.625 inches and mf would be equal to 0.625/0.375 (rounded up to the nearest integer) plus 1 or 3.

Figure 12:
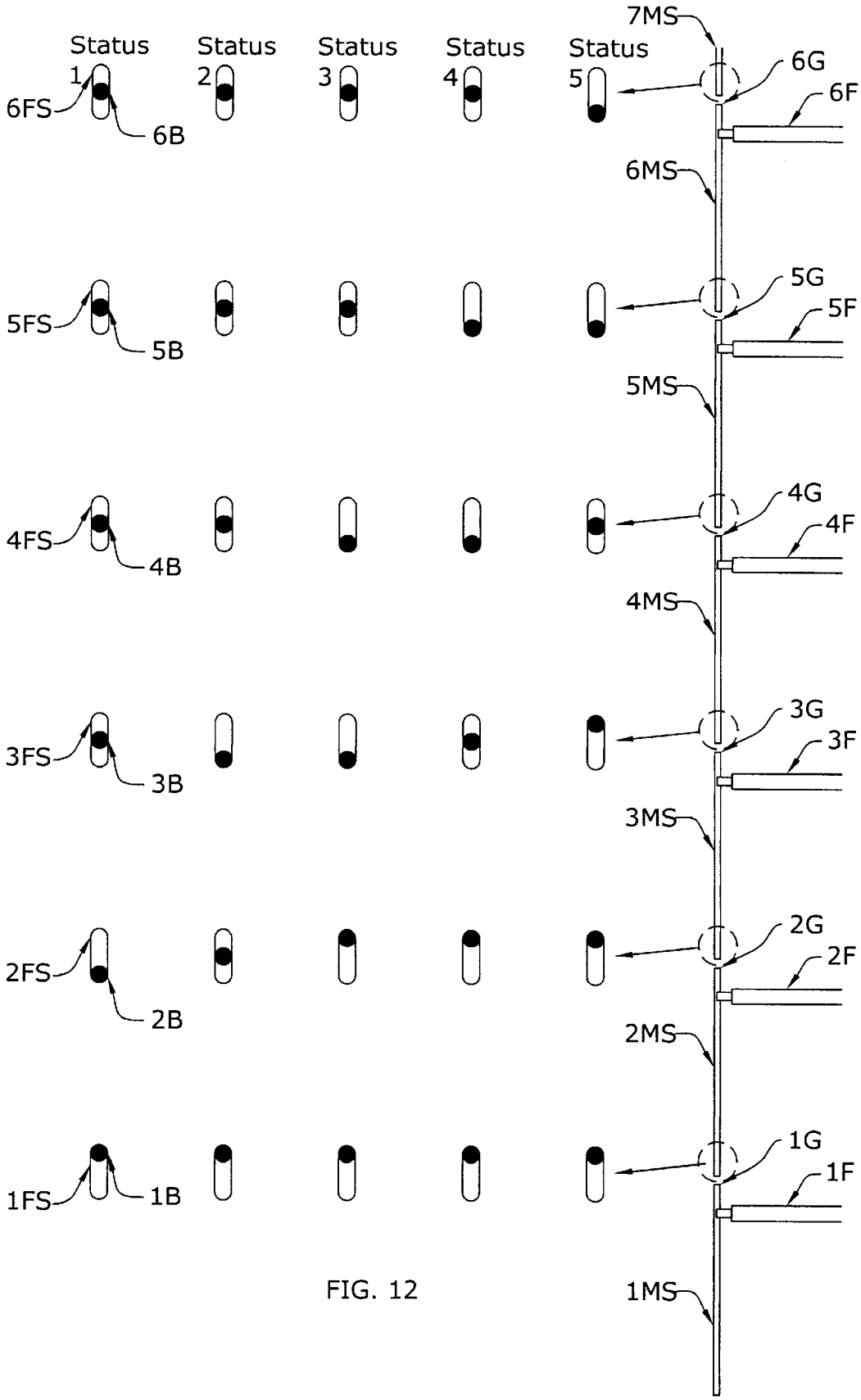
FIG. 12 is a view of gap-limited mullion bolt and gap-limited slot positions in a vertically adjacent mullion sections under different conditions of floor deflections.

FIG. 12 shows the positional status of the gap-limiting bolt 34 in the gap-limiting slot 33 shown in FIG. 11 at adjoining mullion splice joints under various floor load and deflection status conditions. The first status condition is when the second floor 2F is subjected to a maximum live load and a deflection of about twice the limited gap dimension o or n (as shown on FIG. 11) while the remaining floors (the first floor 1F, third floor 3*f*, fourth floor 4*f*, fifth floor 5F, and sixth floor 6F) shown in FIG. 12 are subjected to minimal live loads. In this condition, the second floor 2F moves downward under the live load (carrying the second mullion section 2MS with the first gap limiting slot 1FS and the second mullion-attached gap-limiting bolt 2B downward with it) until the stationary first gap-limiting bolt 1B is at the extreme top of the downwardly moved gap-limiting slot 1FS above the first floor 1F and the second gap-limiting bolt 2B is at the extreme bottom of the gap-limiting slot 2FS in the third mullion section 3MS above the second floor 2F. Further second floor 2F deflection slidably removes the second floor 2F support from second mullion section 2MS (see slotted hole 14*a* in FIG. 11), allowing the second mullion section 2MS to hang on the third mullion section 3MS and/or be supported by the first mullion section 1MS.

Continued downward deflection of the second floor 2F does not further move any mullion section or further affect the support of any mullion section since the second mullion section 2MS is no longer supported by the second floor 2F and further movement of the second mullion section 2MS is avoided. The first gap 1G between the first mullion section 1MS and the second mullion section 2MS is at a minimum (but not necessarily touching as would typically be the case for the open-gap embodiment shown in FIG. 2) and the second gap 2*g* in FIG. 12 between the second mullion section 2MS and the third mullion section 3MS is at a maximum. In contrast to the open-gap embodiment shown in FIG. 2 which can open an unlimited amount, the second gap 2*g* is limited in the amount it can open.

The second status or load/deflection condition shown is when the third floor 3F is subjected to a maximum live load in addition to the maximum live load on the second floor 2F. As the third floor 3F begins to deflect downward, it carries the third mullion section 3MS downward bringing down with it the third gap-limiting bolt 3B in the third gap-limiting slot 3FS and displacing the second gap-limiting slot 2FS such that the second gap-limiting bolt 2B is displaced relatively upward in the second gap-limiting slot 2FS. When the third gap-limiting bolt 3B reaches the bottom of the third gap-limiting slot 3FS (and the second gap-limiting bolt 2B nominally reaches about the center of the second gap-limiting slot 2FS), further deflection of the third floor 3F removes the third floor support from the third mullion section 3MS, but does not cause any further significant deflection of the third mullion section. At this full second and third floor deflection condition or status, the second and third mullion sections 2MS and 3MS are not supported by the second or third floors 2F or 3F, but instead are being supported by the first mullion section 1F (which is in turn supported by the first floor 1F) and the fourth mullion section 4MS which is in turn supported by the fourth floor 4F. The first gap 1G between the first and second mullion sections 1MS and 2MS remains at a minimum (as shown by the upwardmost position of the first gap-limiting bolt 1B in the first gap-limiting slot 1FS), but the second gap 2G between the second and third mullion sections 2MS & 3MS is reduced from a maximum to a nominal or middle condition and the third gap between the third and fourth mullion sections 3MS & 4MS is now at a maximum open limit dimension.

The third status (Status 3) shown is when the fourth floor 4F is subjected to a maximum live load in addition to the maximum live loads on the second floor 2F and third floor 3F. As the fourth floor 4F begins to deflect downward, it carries the fourth mullion section 4MS downward bringing down with it the fourth gap-limiting bolt 4B in the fourth gap-limiting slot 4FS until the fourth gap-limiting bolt is at the bottom of the fourth gap-limiting slot in the fifth mullion section 5MS. Further downward deflection of the fourth mullion section 4MS tends to remove the fourth floor support from this mullion section and transfer at least some of its load to the fifth floor 5F supporting the fifth mullion section 5MS supporting the fourth gap-limiting bolt in the fourth gap-limiting slot 4FS. However, the downward motion of the fourth mullion section 4MS also allows the third and second mullion sections 2MS & 3MS to move downward since the second gap-limiting bolt 2B can move within the second gap-limiting slot 2FS to further narrow the gap between the first and second mullion sections 1MS and 2MS. This deflection of the fourth floor 4F and limited fourth mullion section 4MS deflection displaces the third mullion section 3MS downward until the second gap-limiting bolt 2B is at the extreme upper end of the second gap-limiting slot 2FS. The second gap 2G is nominally now at a minimum dimension while the third and fourth gaps 3G & 4G are nominally at maximum opening dimensions. In essence, the second mullion section 2MS has not moved but the downward motion of the third mullion section moved the second gap-limiting slot 2FS such that the second gap-limiting bolt 2B is displaced relatively upward in the second gap-limiting slot 2FS.

The fourth status shown is when the fifth floor 5F is subjected to a maximum live load in addition to the maximum live loads on the second, third, and fourth floors 2F, 3F, & 4F. As the fifth floor 5F begins to deflect downward, it carries the fifth mullion section 5MS downward bringing down with it the fifth gap-limiting bolt 5B in the fifth gap-limiting slot 5FS until the fifth gap-limiting bolt is at the bottom of the fifth gap-limiting slot in the sixth mullion section 6MS. Further downward deflection of the fifth floor 5F tends to remove fifth floor support from the fifth mullion section 5MS and transfer at least some of its load to the sixth floor 6F supporting the sixth mullion section 6MS and the fifth gap-limiting bolt in the fifth gap-limiting slot 5FS. However, the downward motion of the fifth mullion section 5MS also allows the third and fourth mullion sections 3MS & 4MS to move downward since the third gap-limiting bolt 3B can move within the third gap-limiting slot 3FS to narrow the (previously fully open) gap between the second and third mullion sections 2MS and 3MS. This deflection of the fifth floor 5F and limited fifth mullion section 5MS deflection displaces the fourth mullion section 4MS downward until the third gap-limiting bolt 3B is nominally at about the middle of the third gap-limiting slot 3FS. The second gap 2G remains at a minimum dimension and therefore the second mullion section 2MS tends to also support the upper mullion sections 3MS, 4MS, and 5MS since these sections are no longer supported by the third, fourth and fifth floors 3F, 4F, & 5F. However, the second mullion section 2MS is no longer supported by the second floor 2F, but is instead supported by the first mullion section 1MS, which is in turn supported by the first floor 1S.

The fifth status shown is when the sixth floor 6F is subjected to a maximum live load in addition to the maximum live loads on the second, third, fourth, and fifth floors 2F, 3F, 4F, & 5F. As the sixth floor 6F begins to deflect downward, it carries the sixth mullion section 6MS downward bringing down with it the sixth gap-limiting bolt 6B in the sixth gap-limiting slot 6FS until the sixth gap-limiting bolt is at the bottom of the sixth gap-limiting slot in the seventh mullion section 7MS. Further downward deflection of the sixth mullion section 6MS tends to remove support from this mullion section and transfer at least some of its load to the seventh floor 7F supporting the seventh mullion section 7MS supporting the sixth gap-limiting bolt 6B in the sixth gap-limiting slot 6FS. However, the downward motion of the sixth mullion section 6MS (previously at least partially supporting some of the lower mullion sections) also allows the fifth, and fourth mullion sections 4MS & 5MS to move downward since the fourth gap-limiting bolt 4B can move within the fourth gap-limiting slot 4FS to further narrow the (previously nominally open) gap between the third and fourth mullion sections 3MS and 4MS. This deflection of the sixth floor 6F and limited sixth mullion section 6MS deflection displaces the fifth and fourth mullion section 5 MS & 4MS downward until the third gap-limiting bolt 3B is at the extreme upper end of the third gap-limiting slot 3FS. The second gap 2G remains at a minimum dimension and therefore the second and third mullion section 2MS & 3MS tends to also support the upper mullion sections 4MS, 5MS, and 6MS since these sections are no longer supported by the fourth, fifth, and sixth floors 4F, 5F, & 6F. However, the second and third mullion section 2MS & 3M are no longer supported by the second floor and third floors 2F & 3F, but are instead supported by the first mullion section 1MS which is in turn supported by the first floor 1S.

A process of installing the preferred embodiment of the invention, as illustrated in FIGS. 6, 7, and 11 will now be described assuming slab side anchors 20 are not present in the floor slabs prior to pouring the concrete floor slabs. The preferred process of installing a limited gap embodiment of the invention initially locates the positions of side anchor bolts and drills side anchor bolt holes in the located position into the slab side edge plate or form 2fm. The side anchor bolts 20 are placed in the anchor bolt holes mostly within the cavity created by the form 2FM to be filled with concrete along with rebar 27 and straps 28 prior to pouring concrete.

As shown in FIG. 11, the vertical field positioning of mullion section 4*a* is initiated by placing a shim 31 on the top of the last assembled lower mullion section 5*a*. Preferably, this shim 31 and lower mullion 5*a* placement and positioning are preferably preceded by a shop and/or field preassembly of the splice tube 10*a* to the upper end of the lower mullion section 5*a*. The upper mullion section 4*a* is lowered onto the splice tube 10*a* until the dead weight of the upper mullion section is supported by the shim 31 and the lower mullion section 5*a*. The upper mullion section 4*a* is lowered onto the splice tube 10*a* until the dead weight of the upper mullion section is supported by the shim 31 and the lower mullion section 5*a* previously secured to a slab side anchor of the lower floor (not shown for clarity in FIG. 11). Although the shim 31 is the preferred means for temporarily supporting the upper mullion 4*a* during initial installation, other means for temporarily supporting the upper mullion include gage blocks, spacers, and frangible protrusions on an alternative splice tube.

With reference to FIGS. 6, 7, and 11, once the upper mullion section 4*a* is initially vertically positioned using a shim 31, the upper mullion section 4*a* is preferably loosely connected to the angle clips 19 (at the associated floor) using mullion bolt 13*a* and the associated load bearing plates 23 can be placed as shown with the interior portion of the bearing plate slot 24 firmly seated on the mullion connector 13*a*. After finger tightening the nut 22 on the side anchor bolts 20 if necessary, the in-out slotted holes 26*b* on the angle clip 19 can be used to adjust the in-and out position of the upper mullion section 4*a* followed by finger tightening of the mullion bolt and nut 13*a*. After finger tightening, secure the bearing plate 23 to the upper mullion section 4*a* using the self-drilling and self-tapping bearing plate screws 25. At this point in the process, the upper mullion section 4*a* can no longer move significantly downwardly even if the shim 31 is removed since the screwed-in bearing plate 23 can support the dead weight of the upper mullion section. Left to right adjustment of the upper mullion section 4*a* can be accomplished if needed by loosening the nuts securing the associated angle clips 19 to the side anchor bolts 20. It is preferred to use a measuring tape or a spacer bar to maintain the desired spacing between laterally adjacent mullion sections, but other means for determining the desired left-to-right position may also be used such as bubble levels, visual approximations, or nominally centered positioning. After left-to-right positioning, the shim 31 are removed and the side anchor nuts and mullion nuts tightened.

While the preferred embodiment of the invention has been shown and described, and some alternative embodiments also shown and/or described, changes and modifications may be made thereto with departing from the invention. Accordingly, it is intended to embrace with the invention all such changes, modifications, and alternative embodiments as fall with in the spirit and scope of the appended claims.

What is claimed is:

1. A method of securing a plurality of mullion sections to a plurality of building anchors, each of said mullion sections capable of supporting a portion of a curtain wall assembly, said method comprising:

attaching a first mullion section to a first building anchor assembly such that said attached first mullion section is capable of upwardly supporting a portion of said curtain wall assembly;

slidably attaching a second mullion section to a second building anchor assembly such that a lower end surface of said second mullion section is spaced apart from an upper end surface of said first mullion section by at least about 0.2 cm and said attached second mullion section is capable of sliding upwardly relative to said second building anchor assembly when supported by said first mullion section; and wherein contact between said first and second mullion sections is capable of sliding said second mullion section upwardly relative to said second building anchor and limiting further relative compressive motion between said mullion sections.

2. The method of claim 1 which also comprises the step of attaching a slidable splice tube to one of said mullion sections.

3. The method of claim 2 which also comprises the step of attaching a mullion support tube proximate to said first building anchor.

4. The method of claim 3 which also comprises the step of placing a shim at an upper end surface of said first mullion section.

5. The method of claim 4 which also comprises the step of attaching a weather seal proximate to an upper end surface of said first mullion section.

6. The method of claim 5 wherein said second building anchor assembly moves at least about 0.2 cm relative to said second mullion section.

7. A support assembly for supporting at least a portion of a curtain wall of a building, said support assembly comprising:

a plurality of building anchor assemblies attached to said building;

a first curtain wall support section connected to a first building anchor assembly, said first support section having a first upper end;

a second curtain wall support section connected to a second building anchor assembly, said second support section having a second end spaced apart from said first upper end to form a gap; and means for displacing said second curtain wall support section relative to said second building anchor assembly while supporting said curtain wall portion.

8. The support assembly of claim 7 that also comprises a seal place in contact with a portion of said first and second ends.

9. The support assembly of claim 8 wherein said first upper end includes an exterior notch.

10. The support assembly of claim 8 wherein at least some of said anchor assemblies comprise a slidable mullion connection.

11. The support assembly of claim 10 wherein said slidable mullion connection comprises bolted connector and an elongated slot in said mullion.

12. The support assembly of claim 11 wherein said means for displacing comprises a slidable connection between said first curtain wall support section and said first building anchor assembly and a slidable connection between said first and second curtain wall support sections.

13. A mullion assembly for supporting a portion of a curtain wall that forms a portion of the exterior of a building, said mullion assembly comprising:

a first mullion section extending along a major axis from a first end to a second end;

a first building anchor assembly connected to said building and supporting said first mullion section in a generally vertical orientation of said major axis;

a second mullion section extending along a major axis from a first end to a second end; and means for slidably connecting said second mullion section to a second building anchor assembly such that a first end of said second mullion section is spaced apart from said a second end of said first mullion section and relative motion between said first and second mullion sections is limited even when relative motion between said first and second building anchor assemblies exceeds said limited relative motion between said first and second mullion sections.

14. An apparatus for limiting the axial motion of individually supported sections of an end-to-end assembly of sections, said apparatus comprising:

means for slidably connecting each of said sections to a structural support for each section:

an end connector capable of providing a variable dimension gap between said sections in said assembly; and means for limiting the variation of gap dimensions to a first range of displacements between sections when said structural supports are displaced over a second range of relative displacements between said structural supports and said second range is greater than said first range.

15. The apparatus of claim 14 wherein said means for slidably connecting comprises a connector bolt in a slotted hole in a mullion section.

16. The apparatus of claim 14 wherein said means for limiting the variations in gap dimensions comprises a slidable connector attached to a splice tube sliding in a slot in said mullion section.

17. A connector comprising:

a first slidable connection between a first supported element and a first building support element wherein relative motion between the first supported and first support elements is limited to a first range of relative motion after connecting said first supported element to said first support element; and a second slidable connection between said first supported element and a second supported element wherein relative motion between said first and second supported elements is limited to a second range of relative motion after connecting said first and second supported elements.

18. The connector of claim 17 wherein said second range is less than said first range.

* * * * *